US010937396B2

(12) United States Patent
Fan

(10) Patent No.: US 10,937,396 B2
(45) Date of Patent: Mar. 2, 2021

(54) GUITAR

(71) Applicant: Yunlai Fan, Dalian (CN)

(72) Inventor: Yunlai Fan, Dalian (CN)

( * ) Notice: Subject to any disclaimer, the term of this patent is extended or adjusted under 35 U.S.C. 154(b) by 0 days.

(21) Appl. No.: 16/632,921

(22) PCT Filed: Jun. 1, 2018

(86) PCT No.: PCT/CN2018/089584
§ 371 (c)(1),
(2) Date: Jan. 22, 2020

(87) PCT Pub. No.: WO2019/037507
PCT Pub. Date: Feb. 28, 2019

(65) Prior Publication Data

US 2020/0243048 A1 Jul. 30, 2020

(30) Foreign Application Priority Data

Aug. 22, 2017 (CN) ..... 201710759230.X
Aug. 22, 2017 (CN) ..... 201721097840.X

(51) Int. Cl.
*G10D 1/08* (2006.01)
*G10D 3/06* (2020.01)

(52) U.S. Cl.
CPC ..... *G10D 1/08* (2013.01); *G10D 3/06* (2013.01)

(58) Field of Classification Search
CPC ..... G10D 1/08; G10D 3/06; G10D 3/00
See application file for complete search history.

(56) References Cited

U.S. PATENT DOCUMENTS 5,847,298 A * 12/1998 Adams ..... G10D 3/06 84/314 R
2007/0006710 A1* 1/2007 Chen ..... G10D 3/06 84/291
2010/0064878 A1 3/2010 Stein
2011/0247474 A1 10/2011 Mitchell

FOREIGN PATENT DOCUMENTS

CN 102439658 A 5/2012
CN 204406967 U 6/2015
CN 106898335 A 6/2017
CN 206271402 U 6/2017
CN 107424587 A 12/2017
CN 207367584 U 5/2018

OTHER PUBLICATIONS

International Search Report, State Intellectual Property Office of the P.R. China, Aug. 30, 2018.

* cited by examiner

*Primary Examiner* — Kimberly R Lockett
(74) *Attorney, Agent, or Firm* — Bay State IP, LLC

(57) ABSTRACT

Disclosed is a guitar, including a guitar body (8), a fretboard (7) and a headstock (1). The guitar body (8) is provided with a sound hole (9). The fretboard (7) is mounted between the guitar body (8) and the headstock (1). One end of a string (6) longitudinally arranged above the fretboard (7) is fixed on a bridge (10) of the guitar body (8), and the other end of the string (6) is wound around a tuning peg (3) of the headstock (1). Frets (5) are transversely mounted on the fretboard (7). An additional fret (4) is arranged between every two of the frets (5). By means of adding the additional fret (4) between the frets (5) of traditional guitars, a semi-tone of a minimum interval of a guitar is changed into a quarter tone, thereby making the play melody vary more delicately and making the sound effect better.

1 Claim, 1 Drawing Sheet

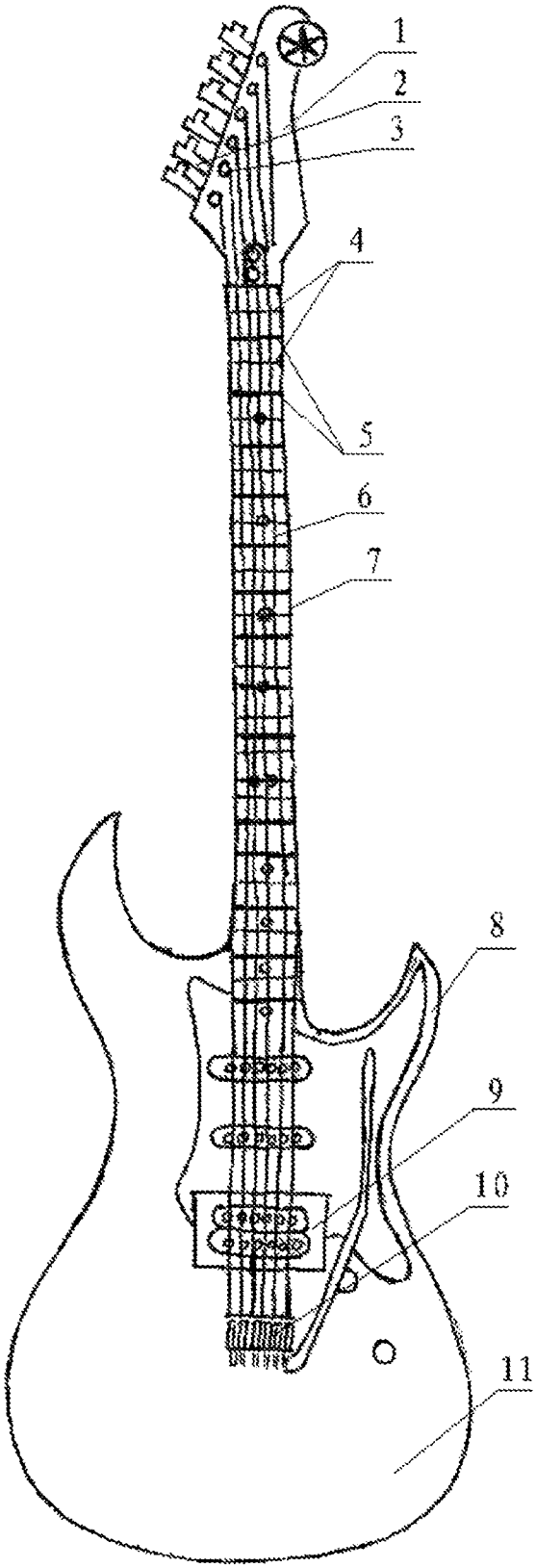
1
2
3
4
5
6
7
8
9
10
11

GUITAR

CROSS REFERENCE TO RELATED APPLICATION

This application is for entry into the U.S. National Phase under § 371 for International Application No. PCT/CN2018/089584 having an international filing date of Jun. 1, 2018, and from which priority is claimed under all applicable sections of Title 35 of the United States Code including, but not limited to, Sections 120, 363, and 365 (c), and which in turn claims priority under 35 USC 119 to Chinese Patent Application No. 201710759230.X filed on Aug. 22, 2017 and Chinese Patent Application No. 201721097840.X filed on Aug. 22, 2017.

TECHNICAL FIELD

The present invention relates to the field of musical instruments, and in particular to the field of plucked instruments.

BACKGROUND

Guitar is a musical instrument, also known as six-stringed musical instrument, which belongs to plucked instruments. The guitar usually has six strings and is similar in shape to violin. Guitar is often regarded as the main musical instrument in pop music, rock music, blues, folk songs and Flamenco. In the field of classical music, guitars are often performed as solos or duets. Certainly, in chamber music and orchestral music, the guitar also plays a considerable role as a foil.

A panel and a back plate of the guitar are flat, and the waist of the guitar is generally not angular but concave inward. A classical guitar is generally not concave. A neck is wide and long. A fretboard has a nut and is provided with a lot of narrow metal horizontal grids that are convex upwards slightly, called frets, which divide strings into many semi-tones. Because a minimum interval is a semi-tone, it is impossible to achieve more delicate melody changes in some playing occasions and the sound effect is poor.

SUMMARY

In order to improve the intonation and sound effect of a traditional guitar, the present invention provides a guitar which can realize a minimum interval of a quarter tone.

The technical solution adopted by the present invention for realizing the foregoing objective is as follows: a guitar, including a guitar body 8, a fretboard 7 and a headstock 1. The guitar body 8 is provided with a sound hole 9. The fretboard 7 is mounted between the guitar body 8 and the headstock 1. One end of a string 6 longitudinally arranged above the fretboard 7 is fixed on a bridge 10 of the guitar body 8, and the other end of the string 6 is wound around a tuning peg 3 of the headstock 1. Frets 5 are transversely mounted on the fretboard 7. An additional fret 4 is arranged between every two of the frets 5.

The additional fret 4 is arranged between every two of the frets 5. The frets 5 and the additional frets 4 are distributed at equal intervals or unequal intervals.

In the guitar provided by the present invention, by means of adding the additional fret between the frets of traditional guitars, a semi-tone of a minimum interval of a guitar is changed into a quarter tone, thereby making the play melody vary more delicately and making the sound effect better.

BRIEF DESCRIPTION OF THE DRAWINGS

FIG. 1 is a schematic structural diagram of a guitar provided by the present invention.

In the FIGURE: 1. headstock, 2. tuner, 3. tuning peg, 4. additional fret, 5. fret, 6. string, 7. fretboard, 8. guitar body, 9. sound hole, 10. bridge, 11. panel.

DESCRIPTION OF THE EMBODIMENTS

As shown in FIG. 1, the guitar structure of the present invention includes a guitar body 8, a fretboard 7 and a headstock 1. The guitar body 8 is use for resonating sounds of strings 6. The guitar body 8 includes a panel 11 and a side plate. The guitar body 8 is provided with a sound hole 9. The fretboard 7 is mounted between the guitar body 8 and the headstock 1. One end of the string 6 longitudinally arranged above the fretboard 7 is fixed on a bridge 10 of the guitar body 8, and the other end of the string 6 is wound around a tuning peg 3 of the headstock 1. The headstock 1 is provided with a tuner 2, and a tone is turn through the tuner 2. Frets 5 are transversely mounted on the fretboard 7. An additional fret 4 is arranged between every two of the frets 5. The frets 5 and the additional frets 4 are distributed at equal intervals or unequal intervals.

A traditional guitar achieves a minimum interval of a half tone, namely a semi-tone. When the guitar is used for playing, because the additional fret 4 is added between every two of the traditional frets 5, a quarter interval is realized, so that when the guitar is played, the melody variation expression is more delicate and the sound effect is better.

The additional fret is added between the frets to achieve a smaller interval. This technology can be applied to all string instruments similar to guitars.

The present invention has been described by way of embodiments, and those skilled in the art know that various changes or equivalent substitutions can be made to these features and embodiments without departing from the spirit and scope of the present invention. In addition, under the instruction of the present invention, these features and embodiments can be modified to adapt to specific situations and materials without departing from the spirit and scope of the present invention. Therefore, the present invention is not limited to the specific embodiments disclosed herein, and all embodiments falling within the scope of the claims of the present application are within the protection scope of the present invention.

What is claimed is:

1. A guitar, comprising a guitar body (8), a fretboard (7) and a headstock (1), wherein the guitar body (8) is provided with a sound hole (9); the fretboard (7) is mounted between the guitar body (8) and the headstock (1); one end of a string (6) longitudinally arranged above the fretboard (7) is fixed on a bridge (10) of the guitar body (8), and the other end of the string (6) is wound around a tuning peg (3) of the headstock (1); frets (5) are transversely mounted on the fretboard (7); an additional fret (4) is arranged between every two of the frets (5), and the frets (5) and the additional frets (4) are distributed at equal intervals or unequal intervals.

* * * * *